US010184744B2

(12) United States Patent
Young et al.

(10) Patent No.: US 10,184,744 B2
(45) Date of Patent: Jan. 22, 2019

(54) QUICK CONNECT FOR PISTOL SUPPRESSOR

(71) Applicant: SMITH & WESSON CORP., Springfield, MA (US)

(72) Inventors: Nolan Blake Young, Eagle, ID (US); Travis Keith Bundy, Boise, ID (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/445,312

(22) Filed: Feb. 28, 2017

(65) Prior Publication Data

US 2017/0167816 A1 Jun. 15, 2017

Related U.S. Application Data

(63) Continuation-in-part of application No. 14/877,000, filed on Oct. 7, 2015, now Pat. No. 9,631,888.

(60) Provisional application No. 62/061,238, filed on Oct. 8, 2014.

(51) Int. Cl.
*F41A 21/32* (2006.01)
*F41C 3/00* (2006.01)

(52) U.S. Cl.
CPC ..... *F41A 21/325* (2013.01); *F41C 3/00* (2013.01)

(58) Field of Classification Search
CPC ..... F41A 21/30; F41A 21/325; F41A 21/32; F41A 21/48
See application file for complete search history.

(56) References Cited

U.S. PATENT DOCUMENTS

| | | | |
|---|---|---|---|
| 4,510,843 | A | 4/1985 | Rabatin |
| 4,893,426 | A | 1/1990 | Bixler |
| 5,433,133 | A | 7/1995 | La France |
| 5,559,302 | A | 9/1996 | Latka |
| 5,685,102 | A | 11/1997 | Latka |
| 7,588,122 | B2 | 9/2009 | Brittingham |
| 7,677,150 | B2 | 3/2010 | Dater et al. |
| 7,743,693 | B1 | 6/2010 | Brittingham |
| 7,891,282 | B1 | 2/2011 | DeGroat |
| 7,946,069 | B2 | 5/2011 | Dueck et al. |
| 8,162,100 | B2 | 4/2012 | Shults et al. |
| 8,210,087 | B2 | 7/2012 | Latka |
| 8,272,306 | B1 | 9/2012 | Smith |
| 8,291,805 | B1 | 10/2012 | Quilligan |

(Continued)

OTHER PUBLICATIONS

U.S. Patent and Trademark Office; Office Action for U.S. Appl. No. 14/877,000; dated Feb. 16, 2017.

*Primary Examiner* — Benjamin P Lee
(74) *Attorney, Agent, or Firm* — Stinson Leonard Street LLP

(57) ABSTRACT

A quick connect for a pistol suppressor includes a housing having a first end, a second end, and a central bore with an upper portion, a lower portion, and an internal shoulder separating the upper and lower portions. A piston is within the central bore of the housing. The piston includes a piston shoulder that creates an upper recess within a central bore of the piston. A ring having a locking profile is selectively connected to the second end of the piston between the housing and the piston and a spring is positioned around an exterior of the piston. A wave spring is positioned in the upper recess of the piston adjacent the piston shoulder and a washer. A cap with a central opening and an internal locking profile is connected to the piston with the wave spring biasing the washer towards the locking profile.

30 Claims, 10 Drawing Sheets

(56) References Cited

U.S. PATENT DOCUMENTS

| | | | |
|---|---|---|---|
| 8,387,299 | B1 | 3/2013 | Brittingham et al. |
| 8,424,441 | B2 | 4/2013 | Brittingham |
| 8,439,155 | B2 | 5/2013 | Schults et al. |
| 8,479,429 | B2 | 7/2013 | Barrett et al. |
| 8,714,300 | B2 | 5/2014 | Johansen |
| 8,857,306 | B1 | 10/2014 | Edsall |
| 8,910,558 | B2 | 12/2014 | Kent |
| 8,950,546 | B2 | 2/2015 | Shults et al. |
| 8,997,621 | B1 | 4/2015 | Dater et al. |
| 9,175,919 | B2 | 11/2015 | Russell et al. |
| 9,513,078 | B1 | 12/2016 | Fulton et al. |
| 9,613,888 | B2 | 4/2017 | Young |
| 9,658,019 | B2 | 5/2017 | Smith |
| 2007/0095198 | A1 | 5/2007 | Dater et al. |
| 2009/0050403 | A1 | 2/2009 | Brittingham |
| 2009/0193963 | A1 | 8/2009 | Poulsen |
| 2010/0229712 | A1 | 9/2010 | Graham |
| 2011/0036233 | A1 | 2/2011 | Degroat |
| 2012/0279381 | A1 | 11/2012 | Landolt |
| 2016/0161203 | A1 | 6/2016 | Wilson |

QUICK CONNECT FOR PISTOL SUPPRESSOR

RELATED APPLICATION DATA

The present application is a continuation-in-part application of U.S. patent application Ser. No. 14/877,000 filed Oct. 7, 2015 entitled "Quick Connect for Pistol Suppressor" and published as U.S. Patent App. Pub. No. 2016/0102935, which claims the benefit of priority under 35 U.S.C. § 119 to U.S. Provisional Application No. 62/061,238, filed Oct. 8, 2014, entitled "Quick Connect for Pistol Suppressor," the disclosures of which are incorporated herein by reference in their entireties.

BACKGROUND

Field of the Disclosure

The embodiments described herein relate to a quick connect for a pistol suppressor.

Description of the Related Art

The barrel of semi-automatic pistols recoils a short distance upon discharging a round before the slide is unlocked. Typically, the barrel of the pistol actually tilts causing the lugs on the barrel and the slide to separate, thus unlocking the slide and allowing the gun to cycle the action after each discharge. The addition of a suppressor to the end of the barrel of such a pistol generally interferes with the tilting of the barrel to cycle the action. It has been known to use a recoiled booster, also referred to as a Nielsen device or a linear inertial decoupler ("LID"), in order to permit the use of a suppressor with such pistols. The LID temporarily decouples the suppressor from the barrel allowing the firearm to properly cycle the action after each discharge.

The use of a LID device generally does not permit the rapid attachment and detachment of a suppressor to the barrel of a pistol, which may limit applicability of using a suppressor with a semi-automatic handgun. A firearm suppressor is typically threaded onto a portion of the LID device, which is generally threaded onto a connector that connects the system to the end of the barrel. The threading of both the suppressor to the LID and the LID to a connector or adapter may prevent the use of a suppressor during military or tactical situations where speed and ease of attachment and detachment is desired.

Accordingly, there is a need to provide a connector that permits the rapid connection of a suppressor to a semi-automatic firearm. Other drawbacks and disadvantages of present semi-automatic handgun suppressor systems may also exist.

SUMMARY

The present disclosure is directed to a quick connect for a pistol suppressor. The quick connect is configured to integrate a LID, also referred to as a Neilson device, to permit the rapid connection of a suppressor to a semi-automatic pistol. The quick connect may address some of the problems and disadvantages discussed above.

One embodiment is a quick connect for a pistol suppressor comprising a housing with a first end and a second end, the housing having a central bore with an upper portion, a lower portion, and an internal shoulder separating the upper portion from the lower portion. The quick connect comprises a piston being positioned within the central bore of the housing, the piston having a first end, a second end, a central bore, and a piston shoulder, the piston shoulder creating an upper recess within the central bore of the piston. The quick connect includes a ring connected to the second end of the piston, the ring being positioned between the housing and the piston and a spring positioned around an exterior of the piston in the lower portion of the central bore of the housing, the spring being positioned between the ring and the internal shoulder of the housing. The quick connect comprises a wave spring positioned in the upper recess of the piston, the wave spring being positioned adjacent the piston shoulder and a washer positioned within the upper recess of the piston. The quick connect includes a cap having a central opening being positioned adjacent the first end of the housing, a portion of the cap being connected to the first end of the piston, the cap having an internal locking profile. The washer is positioned between the wave spring and the internal locking profile of the cap and the wave spring biases the washer towards the internal locking profile of the cap.

The piston of the quick connect may be movable relative to the housing from an initial position within the central bore of the housing, in the initial position the piston shoulder abuts against the internal shoulder of the housing. The ring may compress the spring against the internal shoulder of the housing upon movement of the piston from the initial position. The ring may be threaded onto the second end of the piston and a portion of the cap may be threaded onto the first end of the piston. The central opening of the cap may include a plurality of notches. The notches may provide access to the internal locking profile. The central opening of the cap may include four notches that provide access to the internal locking profile. The housing may include external threads.

One embodiment is a quick connect system for a pistol suppressor comprising a housing with a first end and a second end, the housing having a central bore with an upper portion, a lower portion, and an internal shoulder separating the upper portion from the lower portion. The system comprises a piston being positioned within the central bore of the housing, the piston having a first end, a second end, a central bore, and a piston shoulder, the piston shoulder creating an upper recess within the central bore of the piston. The system includes a ring connected to the second end of the piston, the ring being positioned between the housing and the piston and a spring positioned around an exterior of the piston in the lower portion of the central bore of the housing, the spring being positioned between the ring and the internal shoulder of the housing. The system includes a wave spring positioned in the upper recess of the piston, the wave spring being positioned adjacent the piston shoulder and a washer positioned within the upper recess of the piston. The system includes a cap having a central opening with a plurality of notches being positioned adjacent the first end of the housing, a portion of the cap being connecting to the first end of the piston, the cap having an internal locking profile with the notches configured to provide access to the internal locking profile. The system comprises a cylinder having a plurality of external lugs and a central bore with at least a portion of the central bore including threads, the cylinder configured to be inserted to the central opening of the cap with the plurality of external lugs configured to pass through the notches to selectively engage the internal locking profile. The washer of the system is positioned between the wave spring and the internal locking profile and the wave spring biases the washer towards the internal locking profile of the cap to selectively retain the lugs within the internal locking profile.

The lugs may be rotated to selectively engage the internal locking profile. The cylinder may be threaded onto a barrel of a piston. The piston may be movable relative to the housing from an initial position within the central bore due to the movement of the barrel, in the initial position the piston shoulder may abut against the internal shoulder of the housing. The ring may compress the spring against the internal shoulder of the housing upon movement of the piston from the initial position. The housing may include external threads and an external shoulder, wherein a suppressor may be connected to the housing via the external threads with an end of the suppressor abutted against the external shoulder. The movement of the piston relative to the housing may temporarily uncouple the suppressor from the barrel.

One embodiment is a quick connect system for a firearm suppressor comprising a housing having a first end, a second end, and an internal cavity, wherein an exterior portion of the housing is configured to be connected to a suppressor. The quick connect system comprises a cap operatively connected to the first end of the housing, the cap including a central opening having four notches and an internal locking profile. The quick connect system includes a cylinder having a central bore and four external lugs, a portion of the central bore being configured to be connected to a barrel of a firearm, wherein the four external lugs may pass through the four notches in the central opening of the cap to selectively engage the internal locking profile to selectively connect the cylinder to the cap.

The four external lugs of the quick connect system may be rotated to selectively engage the internal locking profile. The quick connect system may include a biasing mechanism to selectively retain the four external lugs within the internal locking profile. The quick connect system may include a piston positioned within the housing, wherein the cap may be threaded onto an end of the piston and wherein the piston may be configured to axially move within the cavity of the housing. The quick connect system may include a suppressor connected to the exterior of the housing and a barrel of a firearm connected to the cylinder, wherein the movement of the piston relative to the housing temporarily uncouples the suppressor from the barrel of the firearm.

One embodiment is a quick connect for a pistol suppressor comprising a housing with a first end and a second end, the housing having a central bore with an upper portion, a lower portion, and an internal shoulder separating the upper portion from the lower portion. The quick connect comprises a piston being positioned within the central bore of the housing, the piston having a first end, a second end, a central bore, and a piston shoulder, the piston shoulder creating an upper recess within the central bore of the piston and the second end of the piston having a plurality of lugs. The quick connect includes a ring connected to the second end of the piston, the ring being positioned between the housing and the piston, wherein the plurality of lugs of the piston are positioned within the locking profile of the ring. The quick connect includes a spring positioned around an exterior of the piston in the lower portion of the central bore of the housing, the spring being positioned between the ring and the internal shoulder of the housing. The quick connect comprises a wave spring positioned in the upper recess of the piston, the wave spring being positioned adjacent the piston shoulder and a washer positioned within the upper recess of the piston. The quick connect includes a cap having a central opening being positioned adjacent the first end of the housing, a portion of the cap being connected to the first end of the piston, the cap having an internal locking profile. The washer is positioned between the wave spring and the internal locking profile of the cap and the wave spring biases the washer towards the internal locking profile of the cap.

The piston of the quick connect may be movable relative to the housing from an initial position within the central bore of the housing, in the initial position the piston shoulder abuts against the internal shoulder of the housing. The ring may compress the spring against the internal shoulder of the housing upon movement of the piston from the initial position. The ring may be selectively releasable form the piston and the ring may be configured to depress the spring upon an application of a force and may be rotatable to align the plurality of lugs of the pistons with openings in the ring to permit the ring to be removed from the second end of the piston. The central opening of the cap may include a plurality of notches. The notches may provide access to the internal locking profile. The central opening of the cap may include four notches that provide access to the internal locking profile. The housing may include external threads.

One embodiment is a quick connect system for a pistol suppressor comprising a housing with a first end and a second end, the housing having a central bore with an upper portion, a lower portion, and an internal shoulder separating the upper portion from the lower portion. The system comprises a piston being positioned within the central bore of the housing, the piston having a first end, a second end, a central bore, and a piston shoulder, the piston shoulder creating an upper recess within the central bore of the piston and the second end of the piston having a plurality of lugs. The system includes a ring having a locking profile being selectively connected to the second end of the piston, the ring being positioned between the housing and the piston, wherein the plurality of lugs of the piston are positioned within the locking profile of the ring. The system includes a spring positioned around an exterior of the piston in the lower portion of the central bore of the housing, the spring being positioned between the ring and the internal shoulder of the housing. The system includes a wave spring positioned in the upper recess of the piston, the wave spring being positioned adjacent the piston shoulder and a washer positioned within the upper recess of the piston. The system includes a cap having a central opening with a plurality of notches being positioned adjacent the first end of the housing, a portion of the cap being connecting to the first end of the piston, the cap having an internal locking profile with the notches configured to provide access to the internal locking profile. The system comprises a cylinder having a plurality of external lugs and a central bore with at least a portion of the central bore including threads, the cylinder configured to be inserted to the central opening of the cap with the plurality of external lugs configured to pass through the notches to selectively engage the internal locking profile. The washer of the system is positioned between the wave spring and the internal locking profile and the wave spring biases the washer towards the internal locking profile of the cap to selectively retain the lugs within the internal locking profile.

The lugs may be rotated to selectively engage the internal locking profile. The cylinder may be threaded onto a barrel of a piston. The piston may be movable relative to the housing from an initial position within the central bore due to the movement of the barrel, in the initial position the piston shoulder may abut against the internal shoulder of the housing. The ring may compress the spring against the internal shoulder of the housing upon movement of the piston from the initial position. The housing may include external threads and an external shoulder, wherein a suppressor may be connected to the housing via the external threads with an end of the suppressor abutted against the external shoulder. The movement of the piston relative to the housing may temporarily uncouple the suppressor from the barrel.

One embodiment of a quick connect system for a firearm suppressor includes a housing having a first end, a second end, and an internal cavity, wherein an exterior portion of the housing is configured to be connected to a suppressor. The system includes a piston having a first end and a second end positioned within the housing, wherein the first end of the piston is configured to connect to a barrel of a firearm, the piston being movable within the housing, wherein the movement of the piston relative to the housing temporarily uncouples the suppressor from the barrel of the firearm.

The system may include a ring selectively connected to the second end of the piston, the ring being positioned between the housing and the piston. The second end of the piston may include a plurality of lugs, the plurality of lugs of the piston may be positioned within a locking profile of the ring to selectively connect the ring to the piston. The system may include a cap operatively connected to the first end of the piston, the cap may include a central opening having a plurality of notches and an internal locking profile. The system may include a cylinder having a central bore and a plurality of external lugs, a portion of the central bore being configured to be connected to a barrel of a firearm, wherein the plurality of external lugs may pass through the plurality of notches in the central opening of the cap to selectively engage the internal locking profile to selectively connect the cylinder to the cap, wherein the first end of the piston is configured to be connected to a barrel of a firearm via the cap and the cylinder. The system may include a biasing mechanism to selectively retain the plurality of external lugs within the internal locking profile.

Figure 1:
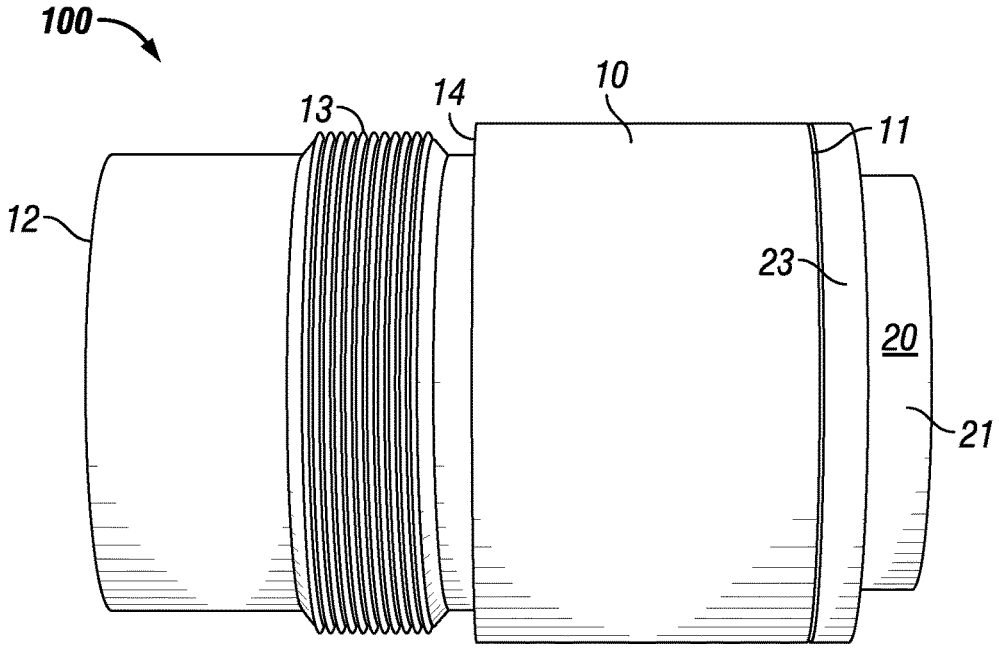
FIG. 1 shows one embodiment of a quick connect for a pistol suppressor.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a quick connect 100 that does not require a separate LID or Nielsen device to decouple a suppressor from the barrel of a pistol. The quick connect 100 includes a housing 10 having a first end 11 and a second end 12. The housing 10 includes exterior threads 13 that permit the connection of a suppressor to the housing 10 as is discussed herein. The housing 10 includes an exterior shoulder 14 against which an end of a suppressor will abut as discussed herein. The quick connect 100 includes a cap 20 having an upper portion 21 and a flange 23. The flange 23 of the cap 20 is positioned adjacent to the first end 11 of the housing 10. The cap 20 may not be connected to the housing 10, but rather may be connected to a piston 50 (shown in FIG. 2) positioned within the housing 10 as detailed herein.

Figure 2:
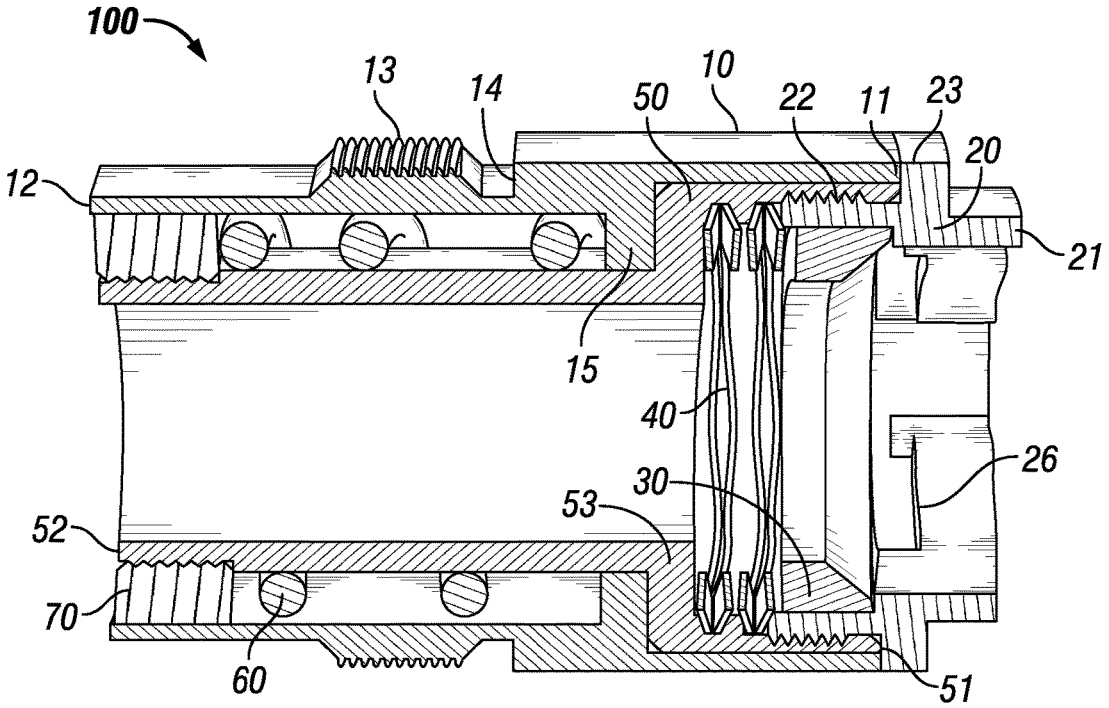
FIG. 2 shows a cross-section view of an embodiment of a quick connect for a pistol suppressor with a piston in an initial position.

FIG. 2 shows a cross-section view of an embodiment of a quick connect 100. The housing 10 includes a central bore (best shown in FIGS. 6 and 7) and an internal shoulder 15 within the central bore that separates the central bore into an upper portion 16 (shown in FIG. 6) and a lower portion 17 (shown in FIG. 7). The quick connect 100 includes a piston 50 having a first end 51, a second end 52, and a piston shoulder 53 between the first and second ends 51 and 52. The piston 50 includes a central bore 54 (shown in FIG. 8) and the piston shoulder 53 defines an upper recess 55 (shown in FIG. 9) within the central bore 54 of the piston 50. The piston 50 is positioned within the central bore of the housing 10 and extends from the first end 11 to the second end 12 of the housing 10 so that the piston 50 is positioned within both the upper and lower portions 16 and 17 of the central bore of the housing 10.

A spring 60 is positioned around the exterior of the piston 50 within the lower portion 17 of the central bore of the housing 10. A ring 70 is connected to the second end 52 of the piston 50. The ring 70 may be connected to the piston 50 by various mechanisms. For example, the ring 70 may be threaded onto the end of the as shown in FIG. 2. The ring 70 traps the spring 60 within an annular gap between the exterior of the piston 50 and the interior of the housing 10. The spring 60 is trapped in the annular space between the ring 70 and the internal shoulder 15 of the housing 10. As discussed herein, the piston 50 and the housing 10 are configured to move axially with respect to each other with the spring 60 biasing the ring 70 and the piston 50 in an initial position with respect to the housing 10 as shown in FIG. 2.

The quick connect 100 includes a biasing mechanism, such as a wave spring 40 positioned in the upper recess 55 of the piston 50. The wave spring 40 is positioned adjacent the piston shoulder 53 in the upper recess 55 of the central bore 54. A lower portion 22 of the cap 20 is connected to the first end 51 of the piston 50. Various mechanisms may be used to connect the cap 20 to the piston 50. For example, the lower portion 22 of the cap 20 may be threaded into first end 51 of the piston 50 as shown in FIG. 2. A washer 30 is positioned between the cap 20 and the wave spring 40 in the upper recess 55 of the central bore 54 of the piston 50. The wave spring 40 biases the washer 30 against an internal locking profile 26 of the cap 20, which may be used to selectively engage a connector within the internal locking profile 26 as would be appreciated by one of ordinary skill in the art having the benefit of this disclosure.

Figure 15:
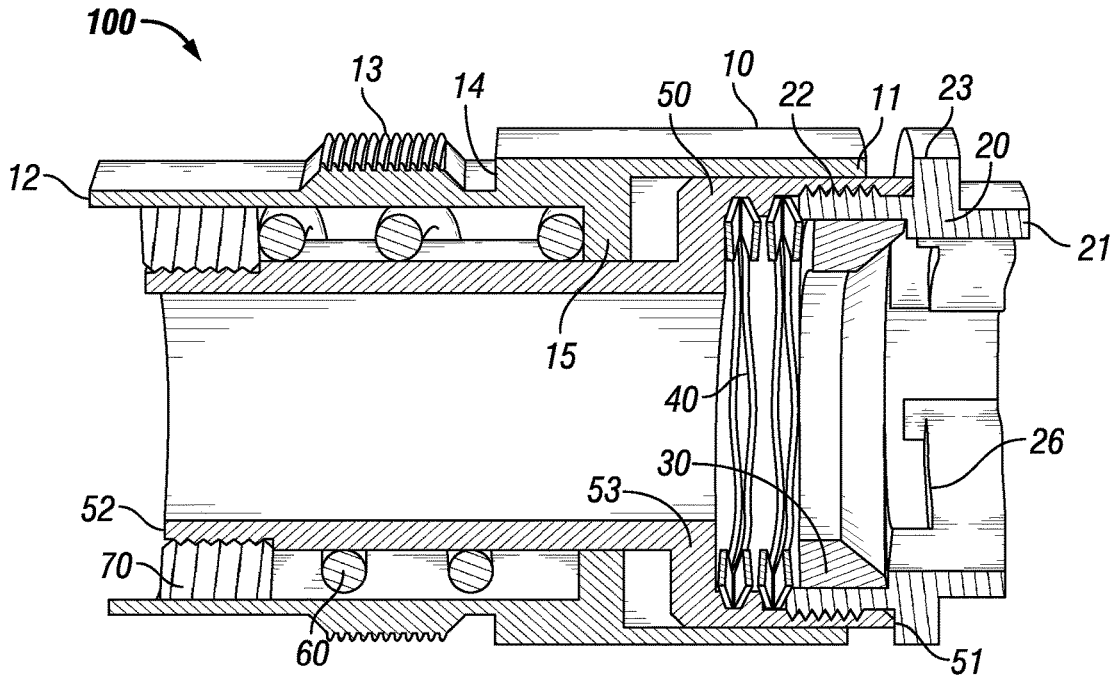
FIG. 15 shows a cross-section view of an embodiment of a quick connect for a pistol suppressor with a piston moved away from the initial position.

The piston 50 and housing 10 are adapted to move axially relative to each other. The movement of the housing 10 with respect from the piston 50 from the initial position (shown in FIG. 2) due to recoil during the discharge of a firearm effectively uncouples a suppressor, which will be connected to the housing via exterior threads 13, from the barrel of the firearm, which will be connected to the piston 50 via the internal locking profile 26 of the cap 20 as described herein. The recoil of the firearm causes the housing 10 to move away from the barrel of the firearm whereas the piston 50 is directly coupled to the barrel via the cap 20, as discussed herein. The movement of the housing 10 with respect to the piston 50 temporarily uncouples the housing 10, and thus the connected suppressor, from the piston 50, which is connected to the barrel of the firearm. As shown in FIG. 15, the uncoupling of the piston 50 and the housing 10 is further illustrated by a gap between the housing 10 and the cap 20, which is directly connected to the piston 50. Thus, the movement of the housing 10 moves the piston 50 away from its initial position (shown in FIG. 2) with respect to the housing as shown in FIG. 15. The movement of the housing 10 will compress the spring 60 between the ring 70 and the internal shoulder 15 of the housing 10. The compression of the spring 60 causes the piston 50 and housing 10 to move back to their initial positions after temporarily being uncoupled. The uncoupling of the piston 50 and housing 10 will not have an effect on the positional relationship between the wave spring 40, washer 30, and internal locking profile 26 of the cap 20 because the cap 20 is connected directly to the piston 50 and the wave spring 40 and washer 30 are trapped between the cap 20 and the piston shoulder 53.

Figure 3:
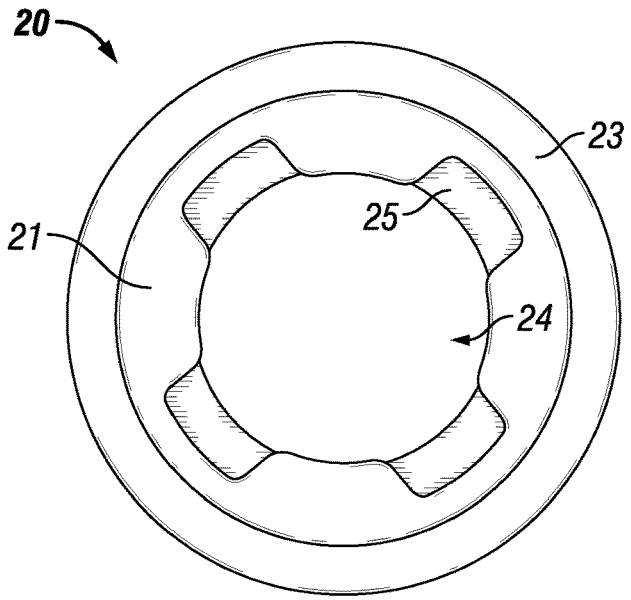
FIG. 3 shows a top view of one embodiment of a cap of a quick connect for a pistol suppressor.
Figure 4:
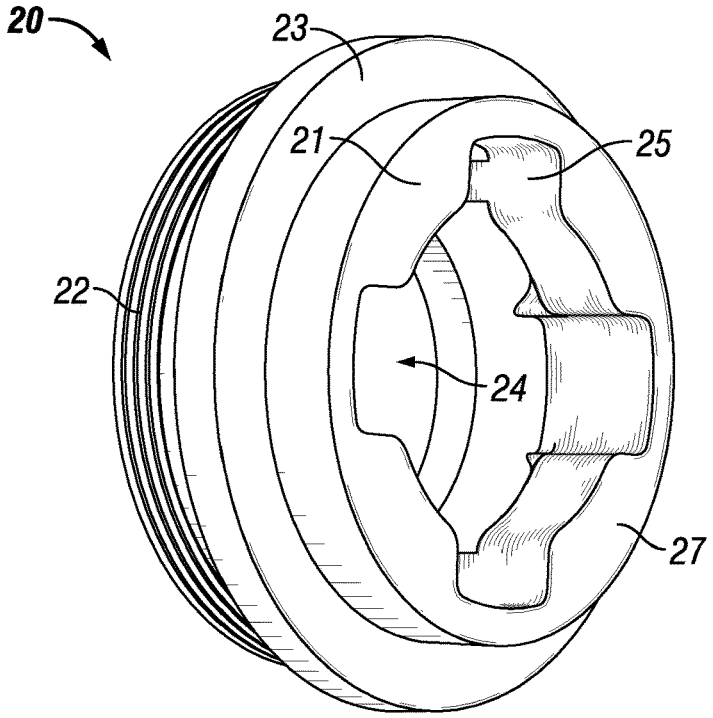
FIG. 4 shows an isometric view of one embodiment of a cap of a quick connect for a pistol suppressor.
Figure 5:
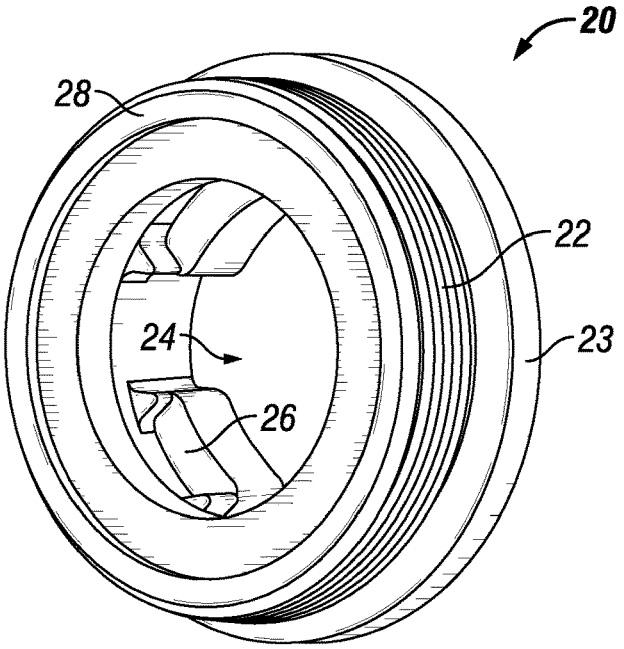
FIG. 5 shows an isometric view of one embodiment of a cap of a quick connect for a pistol suppressor.
Figure 13:
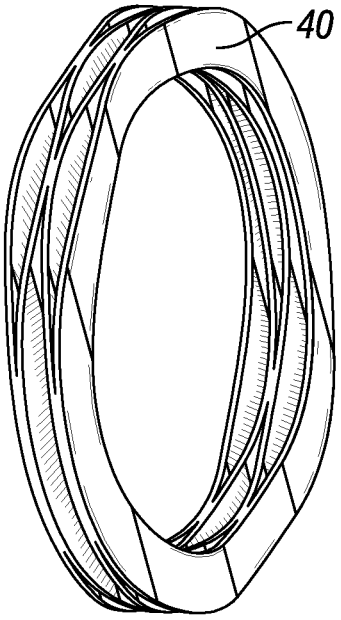
FIG. 13 shows one embodiment of a wave spring for a quick connect for a pistol suppressor.

FIG. 3 shows a top view, FIG. 4 shows an isometric top view, and FIG. 5 shows an isometric bottom view of an embodiment of a cap 20. The cap 20 has an upper portion 21, lower portion 22, and a flange 23 between the upper portion 21 and the lower portion 22. The lower portion 22 may include threads to permit the connection of the cap 20 to the piston 50. The cap 20 includes a central opening 24 that extends from a top surface 27 to a bottom surface 28. The central opening 24 includes a plurality of notches 25 that permit the passage of a locking structure of a connector through the central opening 24 to engage an internal locking profile 26. For example, locking lugs 151 on a cylinder 150 (shown in FIG. 10) may be aligned with the notches 25 to permit the insertion of the cylinder 150 into the central opening 24. The cylinder 150 may then be selectively locked or connected to the cap 20 by rotating the cylinder 150 so that the locking lugs 151 engage the internal locking profile 26. As discussed above, when the cap 20 is connected to the piston 50, the washer 30 that is biased by the wave spring 40 may selectively retain the locking lugs 151 within the internal locking profile 26. FIG. 13 shows an embodiment of a wave spring 40 that may be used with the quick connect 100. To disconnect the cylinder 150, a user may depress the washer 30 and wave spring 40 to disengage the locking lugs 151 from the internal locking profile 26. Then, a user may rotate the cylinder 150 until the locking lugs 151 align with the notches 25 to permit the removal of the cylinder 150 from the central opening 24. As discussed herein, the cylinder 150 may be threaded onto a barrel 300 of a firearm (shown in FIG. 14) and then used to selectively connect the quick connect 100 to the firearm. In this way, the quick connect 100 and cylinder 100 permit the rapid attachment and detachment of an accessory, such as a suppressor 200 (shown in FIG. 14) to the barrel of a firearm. Various locking structures and profiles may be used to selectively secure a barrel 300 to the quick connect 100 as would be appreciated by one of ordinary skill in the art having the benefit of this disclosure. As may also be appreciated from the disclosure herein, the cylinder 150 and an embodiment of the quick connect 100 may be used to connect a suppressor to firearms other than semi-automatic pistols.

Figure 6:
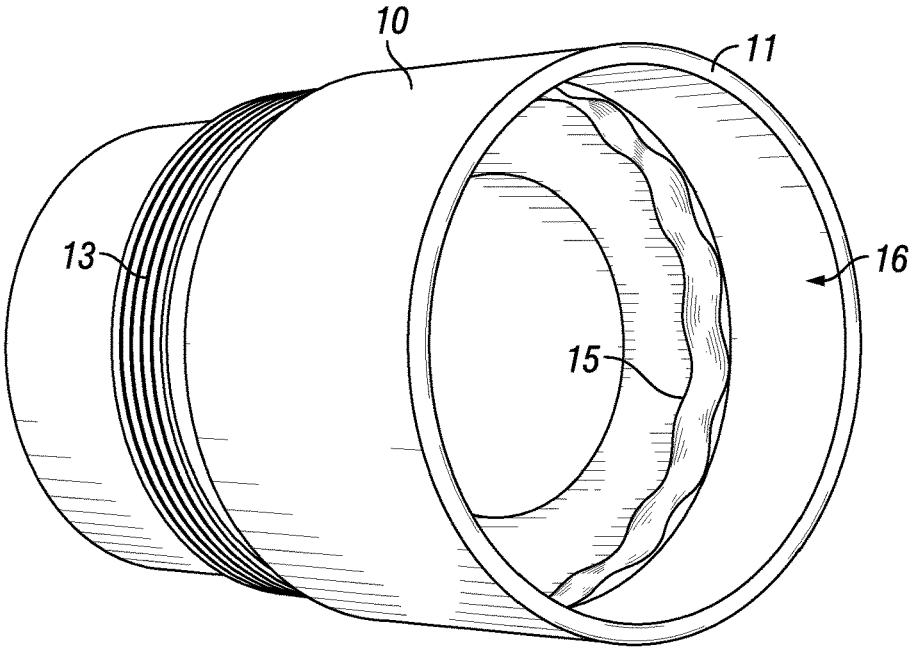
FIG. 6 shows an isometric view of one embodiment of a housing for a quick connect for a pistol suppressor.
Figure 7:
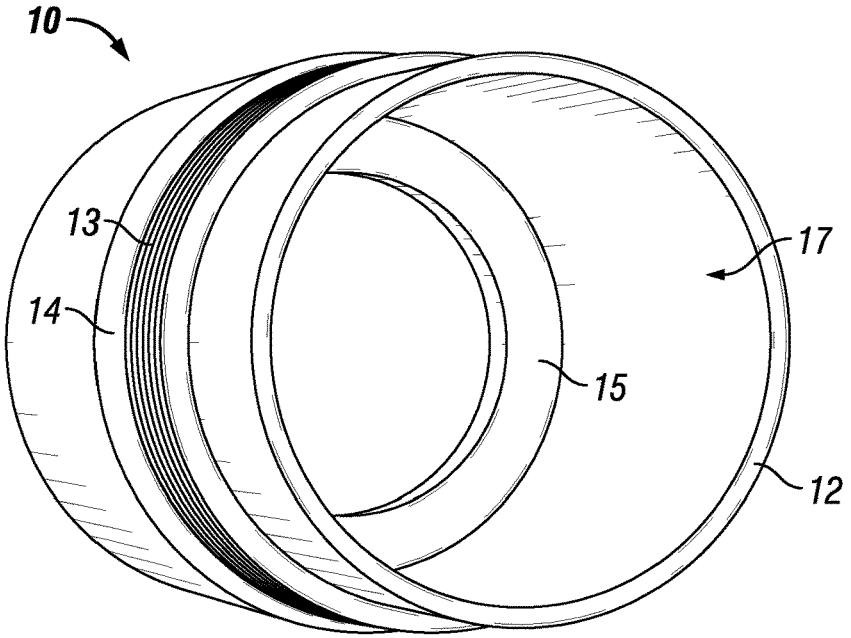
FIG. 7 shows an isometric view of one embodiment of a housing for a quick connect for a pistol suppressor.

FIG. 6 shows an isometric top view and FIG. 7 shows an isometric bottom view of a housing 10 that may be used in connection with the quick connect 100. The housing 10 includes a first end 11, a second end 12, and exterior threads 13 that permit the attachment and detachment of a suppressor 200 to the housing 10. The housing 10 includes an exterior shoulder 14 against which an end of a suppressor will abut. The housing 10 includes an upper portion 16 of a central bore that is separated from the lower portion 17 (shown in FIG. 7) of the central bore by an internal shoulder 15.

Figure 8:
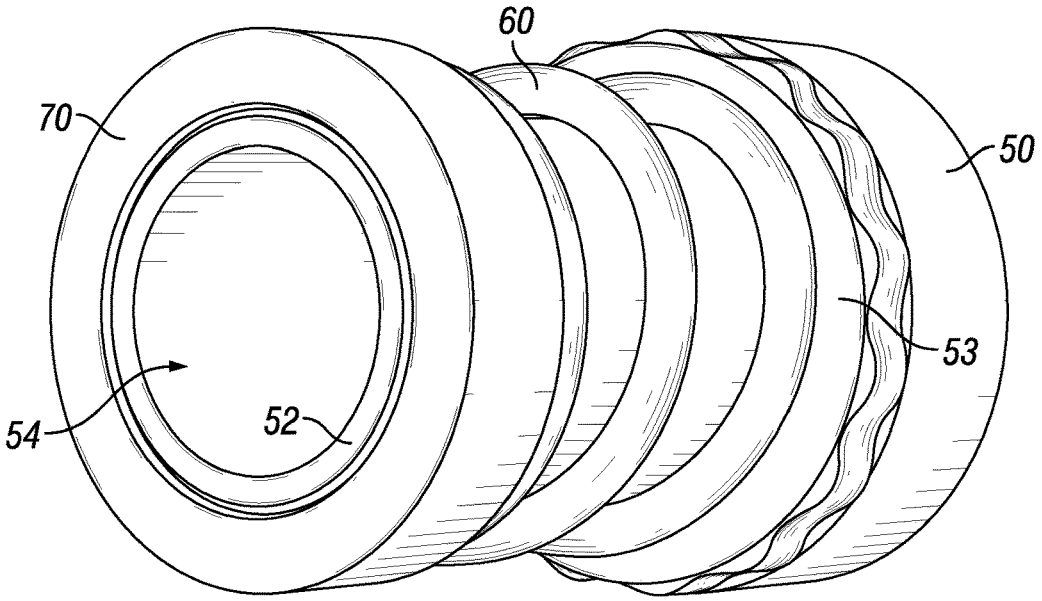
FIG. 8 shows one embodiment of a piston, spring, and ring for a quick connect for a pistol suppressor.
Figure 9:
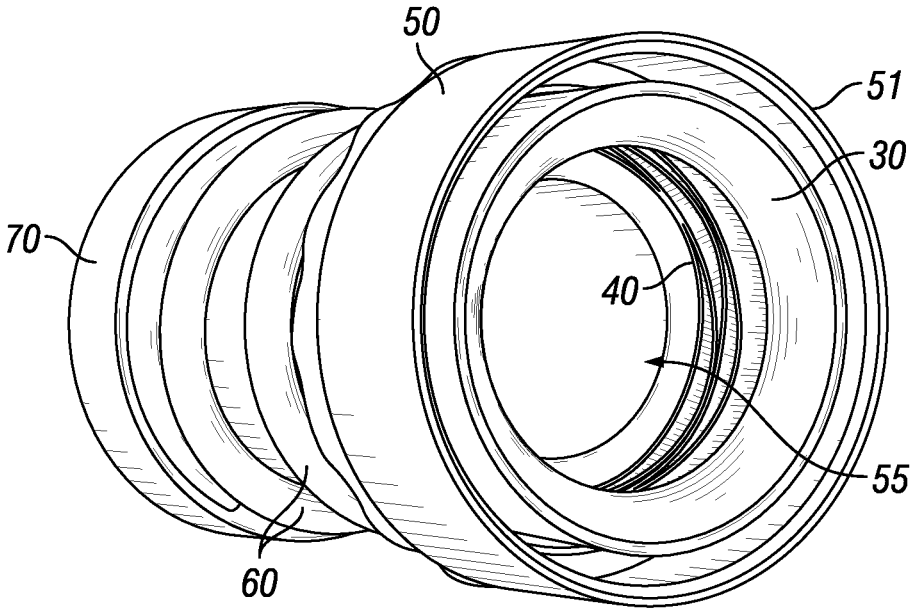
FIG. 9 shows one embodiment of a piston, spring, and ring for a quick connect for a pistol suppressor.

FIG. 8 shows an isometric view of an embodiment of a piston 50 that may be used within the housing 10 of a quick connect 100. A ring 70 is connected to the second end 52 of the piston 50. A spring 60 is positioned around the exterior of the piston 50 between a piston shoulder 53 and the ring 70. The piston includes a central bore 54. FIG. 9 shows an isometric view of the first end 51 of the piston 50 with a wave spring 40 and a washer 30 positioned within an upper recess 55 of the central bore 54 of the piston 50. The upper recess 55 is created by the piston shoulder 53. When installed within the housing 10 of the quick connect 100, the spring 60 is trapped between the ring 70 and the internal shoulder 15 of the housing 10. The spring 60 biases the piston 50 and housing 10 to their initial relative positions as shown in FIG. 2.

Figure 10:
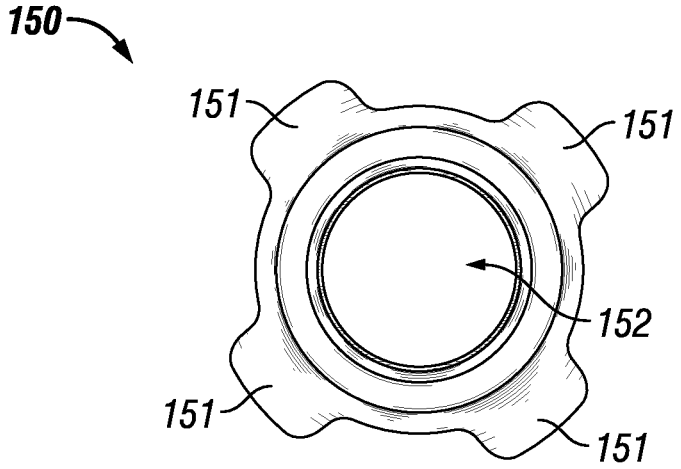
FIG. 10 shows one embodiment of a cylinder with locking lugs for use with a quick connect for a pistol suppressor.
Figure 11:
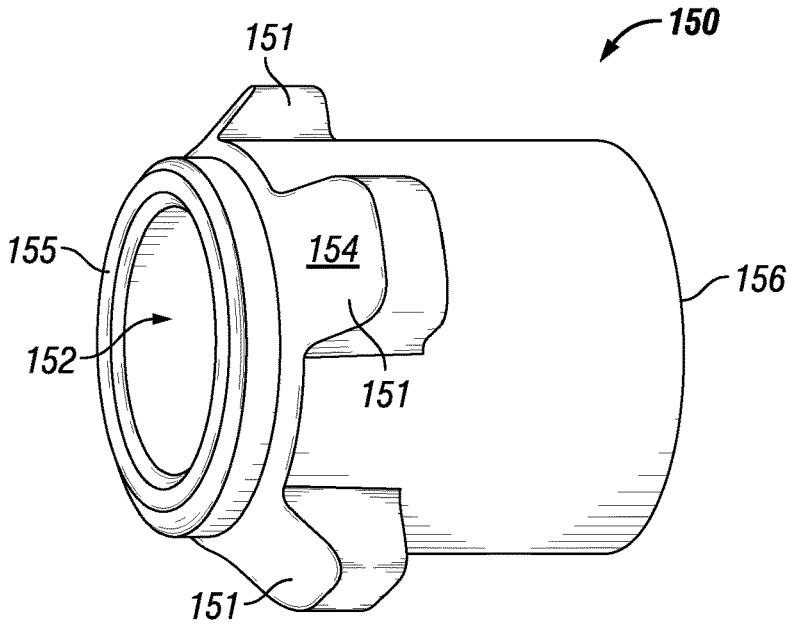
FIG. 11 shows one embodiment of a cylinder with locking lugs for use with a quick connect for a pistol suppressor.

FIG. 10 shows an embodiment of a cylinder 150 that may be threaded onto a barrel 300 of a semi-automatic pistol to permit the rapid attachment and detachment of a suppressor 200 via the quick connect 100. The cylinder 150 includes a plurality of locking lugs 151 and a central opening 152. FIG. 11 shows an isometric view of the cylinder 150. The central opening 152 of the cylinder 150 extends from a first end 155 to a second end 156. The plurality of locking lugs 151 are positioned at the first end 155 of the cylinder 150. The plurality of locking lugs 151 are configured to engage an internal locking profile 26 of the quick connect 100. A surface 154 of the locking lugs 151 may be tapered to aid in the insertion of the locking lugs 151 into the internal locking profile 26. The use of four locking lugs 151 equally spaced around the cylinder 150 may require minimal rotation of the cylinder 150 to engage the internal locking profile 26. Further, the use of four locking lugs 151 on the cylinder may provide better balanced contact surfaces between the locking lugs 151 and the internal locking profile 26.

Figure 12:
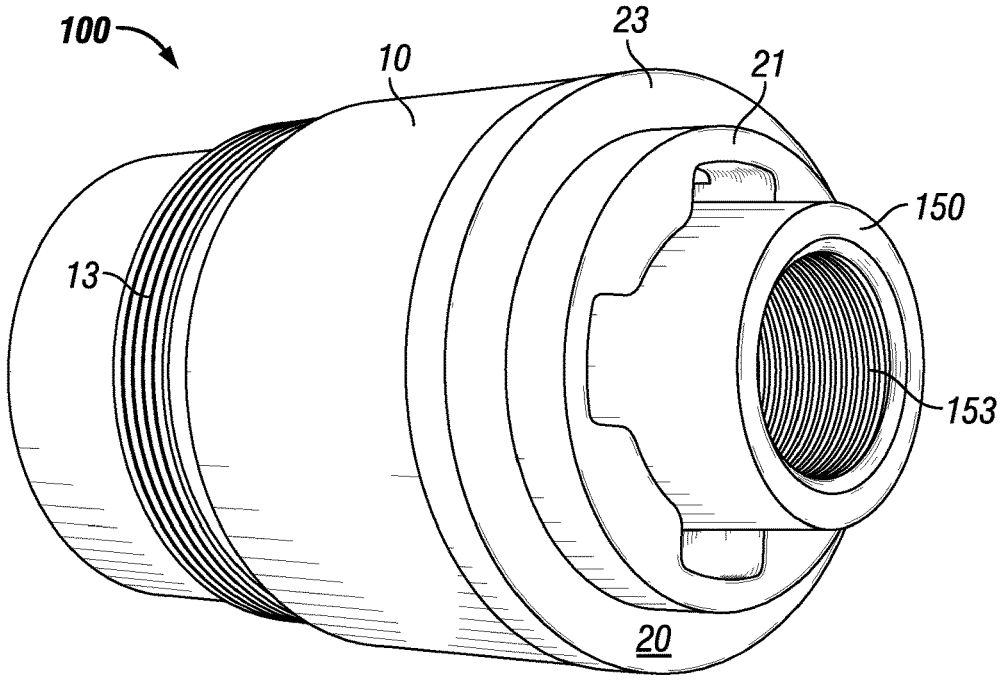
FIG. 12 shows one embodiment of a quick connect and cylinder with locking lugs for a pistol suppressor.
Figure 14:
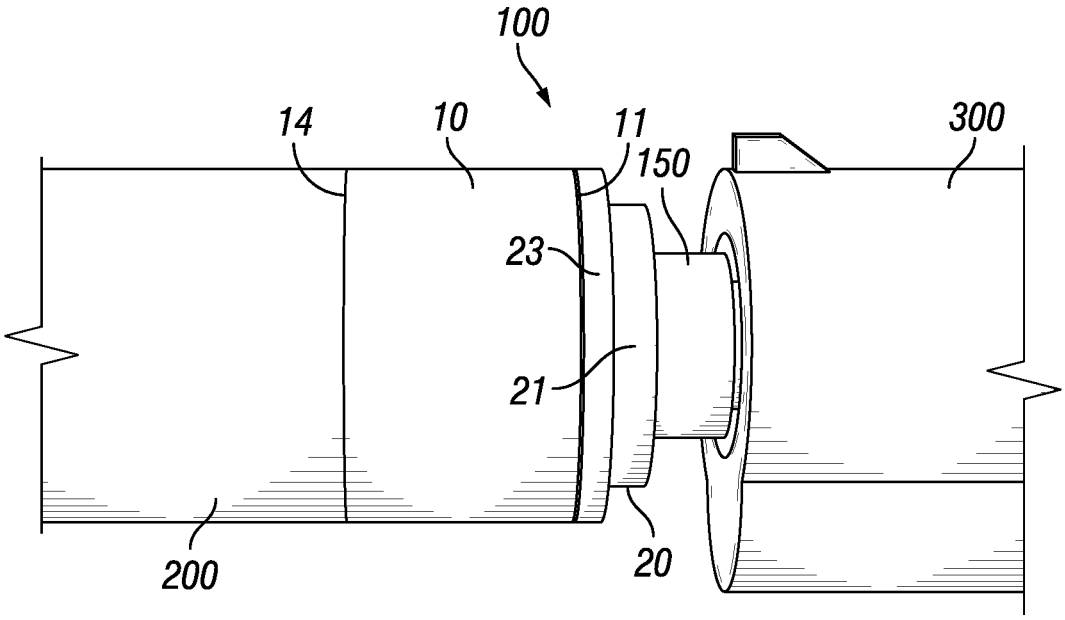
FIG. 14 shows a suppressor connected to a pistol via one embodiment of a quick connect and cylinder with locking lugs.

FIG. 12 shows the cylinder 150 inserted and selectively locked into the quick connect 100. The central opening 152 in the cylinder 150 includes threads 153 so that the cylinder 150 may be threaded onto a barrel 300 of a pistol. The cylinder 150 and quick connect 100 provide for the rapid attachment and detachment of a suppressor 200 to the barrel 300 of a firearm. For example, the cylinder 150 may be threaded onto the barrel 300 of a pistol and the pistol may then be holstered. A suppressor 200 may be threaded onto the quick connect 100 and then stored in a pocket. The cylinder 150 and the cap 20 of the quick connect 100 permit the rapid attachment of the suppressor 200 to the barrel 300 by the simple insertion of the locking lugs 151 of the cylinder 150 into the central opening 24 of the cap 20 followed by less than a quarter rotation of the connected quick connect 100 and suppressor 200. Likewise, the suppressor 200 may be rapidly detached from the barrel 300 by simply depressing the wave spring 40 and rotating the suppressor 200 less than a quarter of rotation in the opposite direction. FIG. 14 shows a suppressor 200 connected to a barrel 300 via the quick connect 100 and the cylinder 150.

Figure 16:
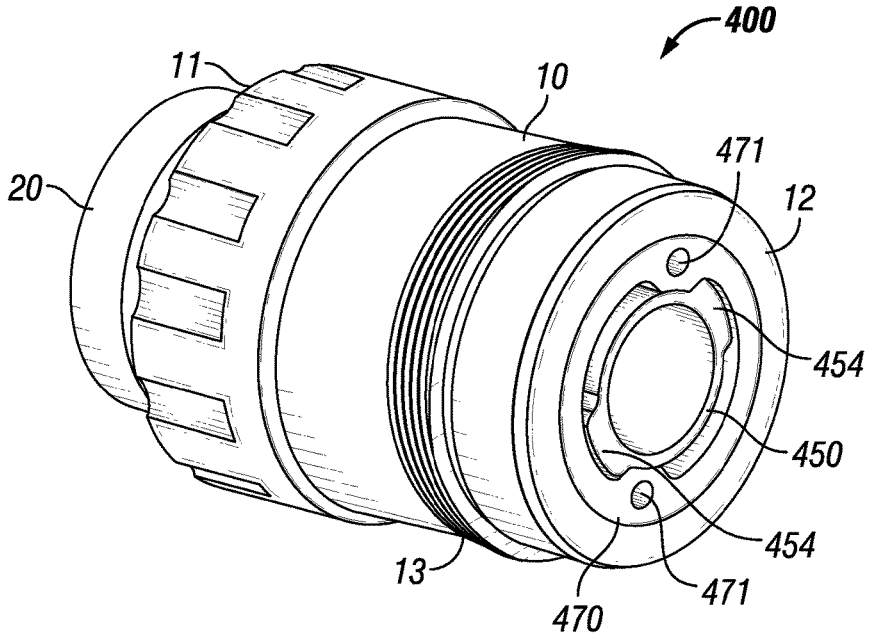
FIG. 16 shows one embodiment of a quick connect for a pistol suppressor.

FIG. 16 shows an embodiment of a quick connect 400 that does not require a separate LID or Nielsen device to decouple a suppressor from the barrel of a pistol. The quick connect 400 includes a housing 10 having a first end 11 and a second end 12. The housing 10 includes exterior threads 13 that permit the connection of a suppressor to the housing 10 as is discussed herein. The housing 10 includes an exterior shoulder 14 (best shown in FIG. 17) against which an end of a suppressor will abut as discussed herein. The quick connect 400 includes a cap 20 having an upper portion 21 and a flange 23 (shown in FIG. 17) positioned adjacent to the first end 11 of the housing 10. The cap 20 may not be connected to the housing 10, but rather may be connected to a piston 450 (best shown in FIG. 17) positioned within the housing 10 as detailed herein.

The quick connect 400 includes a ring 470 that is selectively connected to an end of the piston 450. The piston 450 includes lugs or flanges 454 (hereinafter referred to as lugs) that a selectively retained in a locking profile 472 (shown in FIG. 18) to selectively connect the piston 450 to the ring 470. The ring 470 includes depressions 471 that are configured to permit the insertion of a tool to depress the ring 470 within the housing 10 as detailed herein. The number, size, and/or configuration of the lugs 454 and locking profile 472 are shown for illustration purposes only and may be varied depending on the application as would be appreciated by one of ordinary skill in the art having the benefit of this disclosure.

Figure 17:
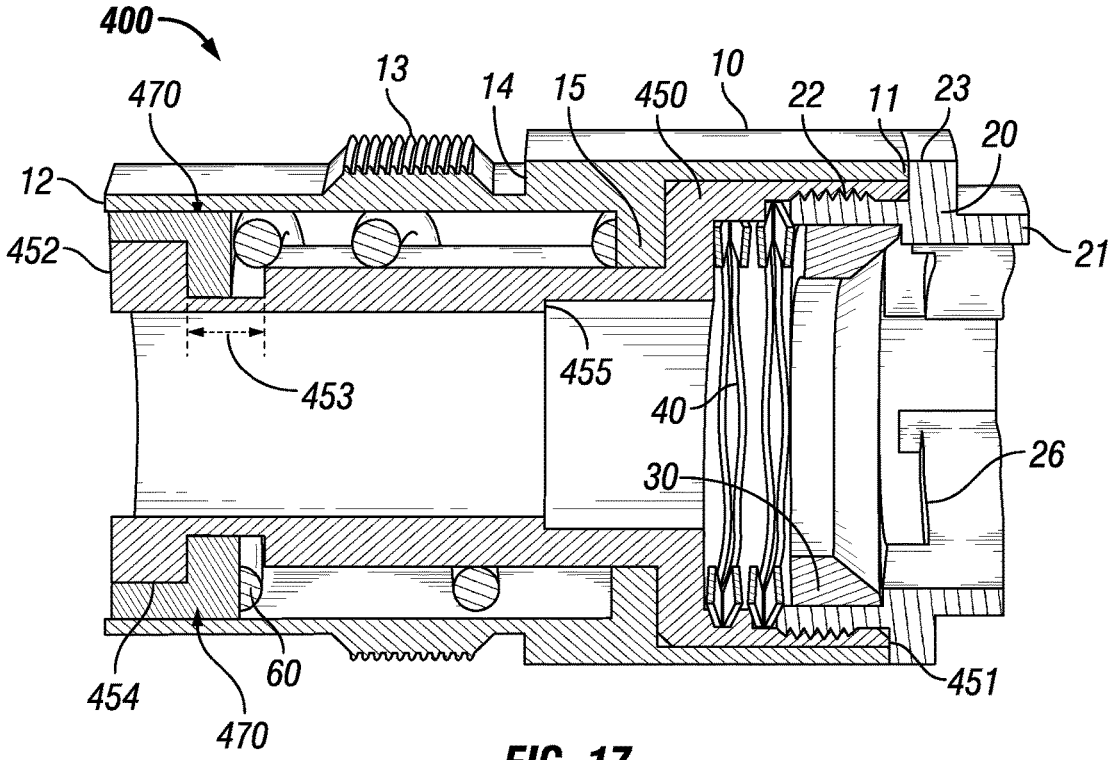
FIG. 17 shows a cross-section view of an embodiment of a quick connect for a pistol suppressor.

FIG. 17 shows a cross-section view of an embodiment of a quick connect 400. The housing 10 includes a central bore and an internal shoulder 15 within the central bore that separates the central bore into an upper portion and a lower portion. The quick connect 400 includes a piston 450 having a first end 451, a second end 452, and an external recess or cavity 453 positioned adjacent to the lugs 454 as illustrated in FIG. 17. The piston 450 includes a central bore and may include an internal shoulder 455 positioned within the central bore. The internal shoulder 455 may aid in alignment when the quick connect 400 is connected to a pistol via a cylinder 150 having locking lugs (shown in FIG. 11) as discussed herein. The piston 450 is positioned within the central bore of the housing 10 and extends from the first end 11 to the second end 12 of the housing 10.

A spring 60 is positioned around the exterior of the piston 450 within the lower portion of the central bore of the housing 10. A ring 470 is connected to the second end 452 of the piston 450. The ring 470 may be connected to the piston 450 by various mechanisms. For example, the ring 470 may include a locking profile 472 and shoulder 473 (shown in FIG. 18) that selectively retain lugs 454 of the piston 450 to selectively connect the piston 450 to the ring 470. The ring 470 traps the spring 60 within an annular gap between the exterior of the piston 450 and the interior of the housing 10. The spring 60 is trapped in the annular space between the ring 470 and the internal shoulder 15 of the housing 10. As discussed herein, the piston 450 and the housing 10 are configured to move axially with respect to each other with the spring 60 biasing the ring 470 and the piston 450 in an initial position with respect to the housing 10 as shown in FIG. 17.

The piston 450 may be selectively released from the ring 470 by applying force to the ring 470 to depress spring 60 against internal shoulder 15 of the housing 10 until the shoulder 473 of the ring 470 moves past the lugs 454 of the piston 450. The ring 470 may then be rotated to permit the lugs 454 of piston 450 to travel along path 474 until the lugs 454 of the piston 450 are aligned with openings 475 of the ring 470. Alignment of lugs 454 with the openings 475 permits the ring 470 to be removed off of the end 452 of the piston 450.

As with the quick connect 100 of FIG. 2, the quick connect 400 of FIG. 17 includes a biasing mechanism, such as a wave spring 40 positioned in the upper recess of the piston 450. The wave spring 40 is positioned adjacent the piston shoulder in the upper recess of the central bore. A lower portion 22 of the cap 20 is connected to the first end 451 of the piston 450. Various mechanisms may be used to connect the cap 20 to the piston 450. For example, the lower portion 22 of the cap 20 may be threaded into first end 451 of the piston 450 as shown in FIG. 17. A washer 30 is positioned between the cap 20 and the wave spring 40 in the upper recess of the central bore of the piston 450. The wave spring 40 biases the washer 30 against an internal locking profile 26 of the cap 20, which may be used to selectively engage a connector within the internal locking profile 26 as would be appreciated by one of ordinary skill in the art having the benefit of this disclosure.

The piston 450 and housing 10 are adapted to move axially relative to each other. The movement of the housing 10 with respect to the piston 450 from the initial position (shown in FIG. 17) due to recoil during the discharge of a firearm effectively uncouples a suppressor (shown in FIG. 14), which may be connected to the housing 10 via exterior threads 13, from the barrel of the firearm (shown in FIG. 14), which may be connected to the piston 450 via the internal locking profile 26 of the cap 20 as described herein. The recoil of the firearm causes the housing 10 to move away from the barrel of the firearm whereas the piston 450 is directly coupled to the barrel via the cap 20, as discussed herein. The movement of the housing 10 with respect to the piston 450 temporarily uncouples the housing 10, and thus the connected suppressor, from the piston 450, which is connected to the barrel of the firearm. The uncoupling of the piston 450 and the housing 10 of the quick connect 400 is similar to the uncoupling of the quick connect 100 as shown in FIG. 15.

Figure 18:
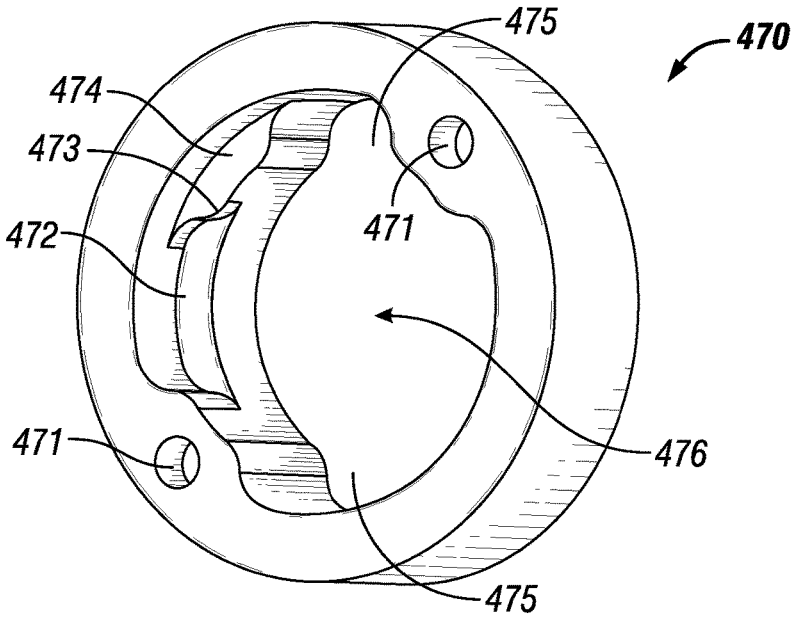
FIG. 18 shows an isometric view of one embodiment of a ring of a quick connect for a pistol suppressor.

FIG. 18 shows an embodiment of a ring 470 that includes a central opening 476 and openings 475. The ring 470 includes a locking profile 472, shoulder 473, and path 474. FIG. 18 shows a single locking profile 472, shoulder 473, and path 474, but the ring 470 includes the number of locking profiles 472, shoulders 473, paths 474, and openings 475 that correspond to the number of lugs 454 on the end of the piston 450 as would be appreciated by one of ordinary skill in the art having the benefit of this disclosure. The locking profile 472 and shoulder 473 are configured to selectively retain a lug 454 of the piston 450 to selectively connect the ring 470 to the piston 450 as discussed herein. As discussed herein, a force is applied to the end of the ring 470 to depress spring 60 and move the ring 470 until the shoulder 473 has moved past the lug 454. Then the ring 470 may be rotated to permit the lug 454 to travel along path 474 until the lug 454 is aligned with opening 475, which permits the ring 470 to be removed off the end of the piston 450. The ring 470 may include a plurality of depressions 471 configured to receive an end of a tool (not shown) to aid in the depression and rotation of the ring 470. The depressions 471 are shown for illustrative purposes only and the size, number, and configuration may be varied as would be appreciated by one of ordinary skill in the art having the benefit of this disclosure.

Figure 19:
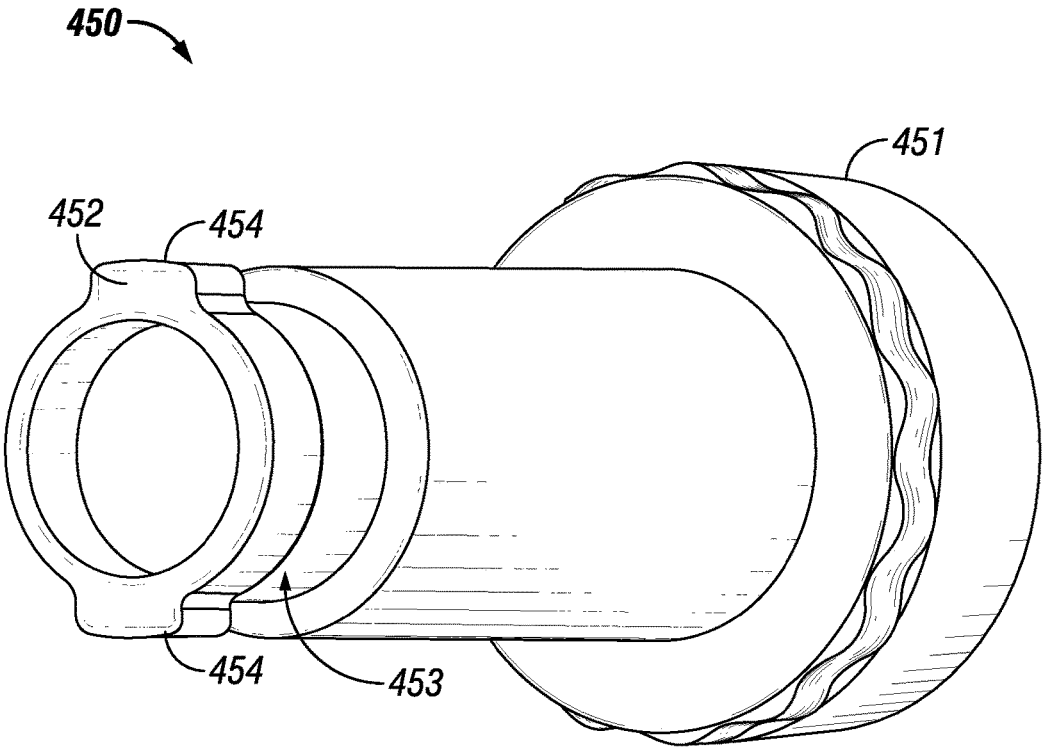
FIG. 19 shows an isometric view of one embodiment of a piston of a quick connect for a pistol suppressor.

FIG. 19 shows an embodiment of a piston 450 that includes a first end 451 and a second end 452. The piston 450 includes a plurality of lugs 454 positioned at the second end 452 and a recess 453 positioned adjacent to the lugs 454. As discussed herein, the lugs 454 are configured to move through openings 475 of the ring 470, move along path 474 of ring 470, and be selecting retained within the locking profile 472 of the ring 470 by shoulder 473. The recess 453 of the piston 450 permits the movement of the ring 470 to depress the spring 60. The number, size, and/or configuration of the lugs 454 and recess 453 may be varied depending on application as would be appreciated by one of ordinary skill in the art having the benefit of this disclosure.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A pistol suppressor quick connect system for use with a barrel quick connector in mounting a pistol suppressor on a barrel of a pistol, the pistol suppressor quick connect system comprising:

a suppressor mount configured to temporarily decouple the pistol suppressor from the barrel responsive to firing of the pistol, the suppressor mount including a housing, a piston, and a spring, the housing including a housing proximal end and a housing distal end, the housing defining a housing bore sized to permit a projectile fired from the pistol to pass from the housing proximal end to the housing distal end through the housing bore when the suppressor mount is mounted on the pistol, the piston positioned at least partially in the housing bore, the piston including a piston proximal end and a piston distal end, the piston defining a piston bore configured to permit a projectile fired from the pistol to pass from the piston proximal end to the piston distal end through the piston bore when the suppressor mount is mounted on the pistol, the piston carrying a suppressor mount quick connector for connecting to the barrel quick connector, the spring being positioned at least partially in a space between the housing and the piston and biasing the piston distally with respect to the housing, the piston being axially movable proximally with respect to the housing to compress the spring responsive to firing of the pistol for temporarily decoupling the pistol suppressor from the barrel, wherein the suppressor mount quick connector is configured to form a quick connection with the barrel quick connector to connect the suppressor mount and barrel quick connector for mounting the suppressor on the barrel, the suppressor mount quick connector including at least one lug or a lug retainer configured for forming the quick connection with the barrel quick connector, wherein said at least one lug or lug retainer is arranged to engage the barrel quick connector to form said quick connection with the barrel quick connector.

2. The pistol suppressor quick connect system of claim 1, wherein the piston is sized and shaped to receive at least part of the barrel quick connector in the piston bore when the quick connection is formed.

3. The pistol suppressor quick connect system of claim 2, wherein the piston is a single piece.

4. The pistol suppressor quick connect system of claim 1, wherein the housing is sized and shaped to receive at least part of the barrel quick connector in the housing bore when the quick connection is formed.

5. The pistol suppressor quick connect system of claim 1, further comprising a resiliently compressible washer in the piston bore adjacent the proximal end of the piston, the resiliently compressible washer shaped and positioned to compress when the quick connection is made with the barrel quick connector.

6. The pistol suppressor quick connect system of claim 5, wherein the piston includes an internal shoulder adjacent the proximal end of the piston, the internal shoulder locating the resiliently compressible washer to bias the barrel quick connector proximally with respect to the piston when the quick connection is formed.

7. The pistol suppressor quick connect system of claim 1, wherein the suppressor mount quick connector comprises the lug retainer, and the lug retainer is separate from and threaded onto the piston.

8. The pistol suppressor quick connect system of claim 7, wherein the lug retainer is a single piece.

9. The pistol suppressor quick connect system of claim 7, wherein the lug retainer comprises a sleeve including a lug locking profile.

10. The pistol suppressor quick connect system of claim 1, in combination with the barrel quick connector, wherein the barrel quick connector comprises at least one lug, and the suppressor mount quick connector comprises the lug retainer, the lug retainer being sized and shaped to retain the at least one lug to releasably maintain the quick connection.

11. The pistol suppressor quick connect system of claim 10, wherein the barrel quick connector comprises a fitting including a fitting body threaded for threading onto the barrel of the pistol, and the fitting includes the at least one lug, the at least one lug including a plurality of lugs extending outward from an outer surface of the fitting body.

12. The pistol suppressor quick connect system of claim 10, wherein the spring is a first spring and the quick connect system further comprises a second spring, the second spring being located in the piston bore, the barrel quick connector sized to be receivable into the piston bore to compress the second spring, and the lug retainer being shaped to permit rotation of the at least one lug, while the barrel quick connector is compressing the second spring, to position the at least one lug in retaining engagement with the lug retainer to form the quick connection.

13. The pistol suppressor quick connect system of claim 1, wherein said spring is a first spring and the system further comprises a second spring in the piston bore, and wherein the second spring is shaped and positioned to be compressed by the barrel quick connector in forming the quick connection.

14. The pistol suppressor quick connect system of claim 1, wherein the suppressor mount is releasably securable to the pistol suppressor.

15. The pistol suppressor quick connect system of claim 1, wherein said at least one lug or lug retainer is proximally movable conjointly with the piston with respect to the housing responsive to firing of the pistol for temporarily decoupling the pistol suppressor from the barrel.

16. The pistol suppressor quick connect system of claim 1, wherein the suppressor mount quick connector includes a spring structure, the spring structure arranged to releasably maintain said quick connection with the barrel quick connector when the quick connection is formed.

17. The pistol suppressor quick connect system of claim 1, wherein the housing is a single piece.

18. A pistol suppressor connection system for mounting a pistol suppressor on a barrel of a pistol, the pistol suppressor connection system comprising:

a suppressor mount configured to temporarily decouple the pistol suppressor from the barrel responsive to firing of the pistol, the suppressor mount including a housing, a piston, and a spring, the housing including a housing proximal end and a housing distal end, the housing defining a housing bore sized to permit a projectile fired from the pistol to pass from the housing proximal end to the housing distal end through the housing bore when the suppressor mount is mounted on the pistol, the piston positioned at least partially in the housing bore, the piston including a piston proximal end and a piston distal end, the piston proximal end being configured for connecting to the barrel of the pistol, the piston defining a piston bore sized to permit a projectile fired from the pistol to pass from the piston proximal end to the piston distal end through the piston bore when the suppressor mount is mounted on the pistol, the spring being positioned at least partially in a space between the housing and the piston, the suppressor mount further including a spring retainer releasably secured to the piston, the spring having a distal portion engaging the spring retainer to bias the piston distally with respect to the housing, the piston being axially movable proximally with respect to the housing to compress the spring responsive to firing of the pistol for temporarily decoupling the pistol suppressor from the barrel.

19. The pistol suppressor connection system of claim 18, wherein the spring retainer and piston are configured to form a quick connection to releasably secure the spring retainer to the piston, the quick connection including at least one lug and a lug retainer, the lug retainer being configured to retain the at least one lug to releasably maintain the quick connection.

20. The pistol suppressor connection system of claim 19, wherein the piston includes the at least one lug, the at least one lug comprising a plurality of lugs, and wherein the spring retainer defines the lug retainer, the lug retainer being configured to retain the plurality of lugs to releasably maintain the quick connection.

21. The pistol suppressor connection system of claim 19, wherein the at least one lug comprises a plurality of lugs and the lug retainer includes a lug locking profile, the spring biasing the lug locking profile against the lugs, the lugs being releasable from the lug locking profile by compressing the spring and rotating the lugs with respect to the lug retainer for disconnecting the spring retainer from the piston.

22. The pistol suppressor connection system of claim 18, wherein the suppressor mount is configured to be releasably securable to the pistol suppressor.

23. The pistol suppressor connection system of claim 18, wherein said spring retainer is movable proximally with the piston with respect to the housing to compress the spring responsive to firing of the pistol for temporarily decoupling the pistol suppressor from the barrel.

24. The pistol suppressor connection system of claim 18, wherein the spring has a proximal portion engaging the housing to bias the piston distally with respect to the housing.

25. The pistol suppressor connection system of claim 24, wherein the housing is a single piece.

26. A pistol suppressor connection system for mounting a pistol suppressor on a barrel of a pistol, the pistol suppressor connection system comprising:

a suppressor mount configured to temporarily decouple the pistol suppressor from the barrel responsive to firing of the pistol, the suppressor mount including a housing, a piston, and a spring, the housing including a housing proximal end and a housing distal end, the housing defining a housing bore sized to permit a projectile fired from the pistol to pass from the housing proximal end to the housing distal end through the housing bore when the suppressor mount is mounted on the pistol, the piston positioned at least partially in the housing bore, the piston including a piston proximal end and a piston distal end, the piston proximal end being configured for connecting to the barrel of the pistol, the piston defining a piston bore sized to permit a projectile fired from the pistol to pass from the piston proximal end to the piston distal end through the piston bore when the suppressor mount is mounted on the pistol, the spring being positioned at least partially in a space between the housing and the piston and biasing the piston distally with respect to the housing, the spring having a proximal end and a distal end, the piston including a piston shoulder spaced proximally from the distal end of the spring, the piston shoulder engaging the housing to limit axial movement of the piston distally with respect to the housing, the piston being axially movable proximally with respect to the housing to compress the spring responsive to firing of the pistol for temporarily decoupling the pistol suppressor from the barrel.

27. The pistol suppressor connection system of claim 26, wherein the piston shoulder is positioned proximally from the proximal end of the spring.

28. The pistol suppressor connection system of claim 26, further comprising a spring retainer releasably secured to the piston distally from the piston shoulder, and wherein the spring engages the spring retainer to bias the piston distally with respect to the housing.

29. The pistol suppressor connection system of claim 26, wherein the suppressor mount is configured to be releasably securable to the pistol suppressor.

30. The pistol suppressor connection system of claim 26, wherein the housing is a single piece.

* * * * *